United States Patent [19]

Barbagli

[11] Patent Number: 4,776,164

[45] Date of Patent: Oct. 11, 1988

[54] HYDRAULIC-ELECTRIC CONTROL CIRCUIT FOR EARTH-MOVING MACHINE MAIN ENGINE

[75] Inventor: Rino Oreste Barbagli, Borgaretto, Italy

[73] Assignee: Fiatallis Europe S.p.A., Stupinigi, Italy

[21] Appl. No.: 16,828

[22] Filed: Feb. 20, 1987

[30] Foreign Application Priority Data

Feb. 21, 1986 [IT] Italy ..... 67135 A/86

[51] Int. Cl.[4] ..... F15B 13/08; F02D 11/06; H01H 35/38; F04B 49/02

[52] U.S. Cl. ..... 60/423; 60/427; 60/431; 123/357; 137/625.68; 200/81.9 R

[58] Field of Search ..... 60/423, 431, 47, 433; 91/304, 461, 52, 424; 200/81.9 R, 82 R; 123/357, 385, 386, 387; 137/625.68

[56] References Cited

U.S. PATENT DOCUMENTS

| | | | |
|---|---|---|---|
| 2,916,576 | 12/1959 | Croskey et al. | 200/81.9 R |
| 3,023,781 | 3/1962 | Larsen | 91/52 X |
| 3,159,965 | 12/1964 | Woolley et al. | 60/433 X |
| 4,044,795 | 8/1977 | Tardy et al. | 137/625.6 |
| 4,066,103 | 1/1978 | Tandrup | 91/52 X |
| 4,085,305 | 4/1978 | Dietz | 200/81.9 R X |
| 4,184,512 | 1/1980 | Pignolet | 137/596 |
| 4,342,335 | 8/1982 | Reinicker et al. | 137/625.6 X |
| 4,400,939 | 8/1983 | Moranduzzo et al. | 60/431 |
| 4,475,519 | 10/1984 | Eheim et al. | 123/387 X |
| 4,533,802 | 8/1985 | Spalding | 200/81.9 R |
| 4,606,313 | 8/1986 | Izumi et al. | 123/386 |
| 4,638,779 | 1/1987 | Kitada | 123/385 |
| 4,643,146 | 2/1987 | Spriessler | 123/385 X |

FOREIGN PATENT DOCUMENTS

| | | | |
|---|---|---|---|
| 2519436 | 7/1983 | France . | |
| 57-47003 | 3/1982 | Japan | 60/433 |
| 58-133451 | 8/1983 | Japan | 123/385 |
| 2080499 | 2/1982 | United Kingdom . | |

*Primary Examiner*—Abraham Hershkovitz
*Assistant Examiner*—George Kapsalas
*Attorney, Agent, or Firm*—Sughrue, Mion, Zinn, Macpeak and Seas

[57] ABSTRACT

An earth-moving machine has an automatic device for minimizing the running speed of the main engine when no power is required by the hydraulic actuators. This device establishes a predetermined hydraulic fluid flow-rate in the servocontrol in the non-neutral position of the servocontrol itself. This flow-rate is indicated by an on-off flow-rate sensor inserted in the auxiliary hydraulic control circuit between the pump and the servocontrols, this sensor controlling the variation in the operating condition of the injection pump of the main engine by means of an electromagnet.

1 Claim, 3 Drawing Sheets

HYDRAULIC-ELECTRIC CONTROL CIRCUIT FOR EARTH-MOVING MACHINE MAIN ENGINE

BACKGROUND OF THE INVENTION

1. Field of the Invention

The present invention relates to an earth-moving machine of the type including a plurality of servocontrols operable from a neutral position by the operator and connected to respective hydraulic distributors by means of an auxiliary hydraulic circuit including a pump driven by the main engine of the machine.

By "main engine" is meant the internal combustion engine which normally drives all the hydraulic jacks and hydrostatic motors of the machine through a pump unit and associated hydraulic circuitry.

During operation of an earth-moving machine, for example an excavator, the operator fixes the running speed of the main engine at a value close to its maximum speed in order to have sufficient power to operate the working members under any conditions. In this situation, even when the members are temporarily inoperative, the main engine of the machine continues to run at high speed with consequent high fuel consumption and wear of the engine itself.

DESCRIPTION OF THE PRIOR ART

Devices have already been proposed which attempt to reduce the running speed of the main engine when no power is required for the working members. Such systems include a plurality of sensors for detecting all the operating pressures of the working members. This makes the device very complicated, given that current earth-moving machines have a large number of controls.

SUMMARY OF THE INVENTION

The object of the pressent invention is to provide an earth-moving machine which solves the problem of the automatic reduction of the running speed of the main engine in a simple and cheap manner, but without the disadvantages of the prior art solutions.

This object is achieved by virtue of the fact that, in the non-neutral position, the servocontrols allow a predetermined flow of hydraulic fluid through the auxiliary circuit, and in that at least one flow-rate sensor device is interposed between the pump and the servocontrols and is arranged to pilot, through actuator means, the variation in the running speed of the main engine between a minimum speed and an operating speed, or vice versa, in order to establish or stop the flow.

By virtue of these characteristics, the operation of any one of the numerous servocontrols present in the machine is detected with a single flow sensor. Moreover, it is possible to regulate the operating time of the device by means of a single sensor.

Further advantages and characteristics of the machine according to the present invention will become apparent from the detailed description which follows, purely by way of non-limiting example, with reference to the appended drawings, in which:

DESCRIPTION OF THE PREFERRED EMBODIMENT

Figure 1:
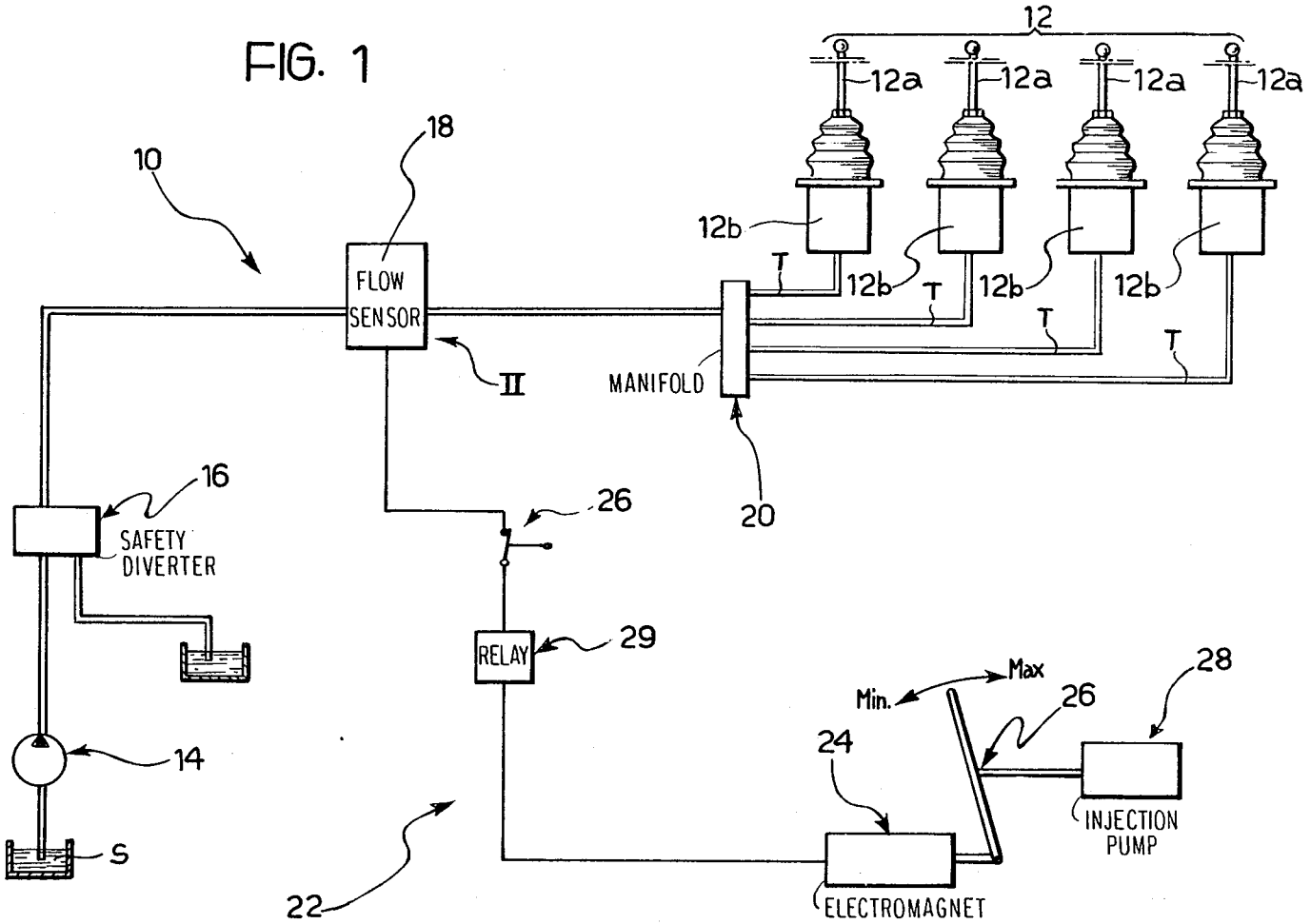
FIG. 1 is a block diagram of the automatic device of the machine of the invention.

With reference to the drawings, there is generally indicated 10 an auxiliary hydraulic circuit for controlling the distributors (not illustrated) of the working members of an earth-moving machine through manually-operable servocontrols, indicated 12. The hydraulic circuit 10 includes a hydraulic fluid reservoir S, a pump 14, a safety diverter 16, a flow sensor 18, and a manifold 20 for dividing the supply to the servocontrols 12.

The sensor 18 is connected through an electrical circuit, generally indicated 22, to an electromagnet 24 with the interposition of a manually-operable switch 26 and a power relay 29. The electromagnet 24 controls the operating condition of an injection pump 28 of the diesel engine of the machine (not illustrated) through a linkage 26.

Figure 3:
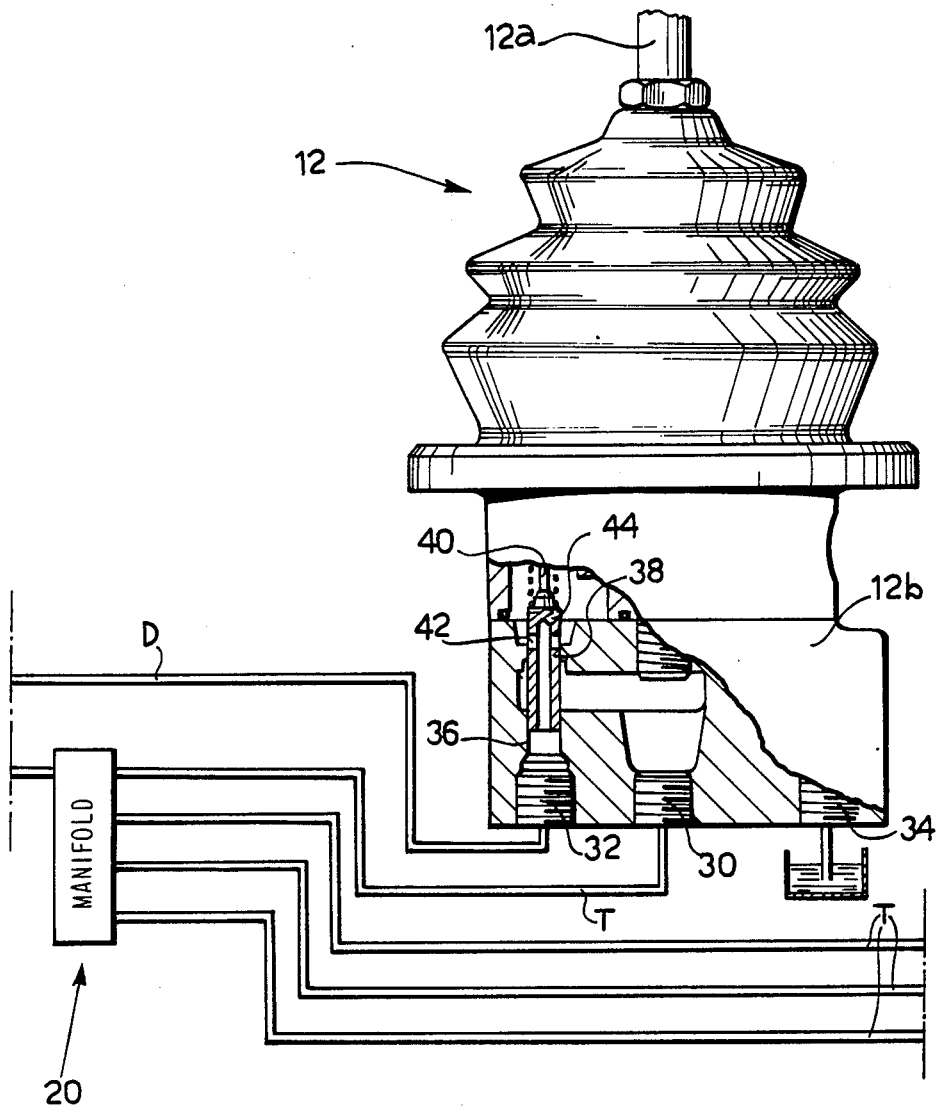
FIG. 3 is a partially-sectioned view of another component of FIG. 1, on an enlarged scale.

An independent supply line T is provided between each servocontrol 12 and the manifold 20. As will be seen from FIG. 3, the servocontrols 12 are essentially of a type known to an expert in the art, whereby they will be described briefly to indicate the characteristics which distinguish them from the known ones.

Each servocontrol 12 has a control lever **12*a* and a support base 12*b*. In the base 12*b* there are respective connectors 30, 32 and 34 for connection to the supply line T of the servocontrol, for connection to a control line D of the respective distributor, and for eventual discharge of hydraulic fluid. In correspondence with the connector 32, the base 12*b* has a cylindrical seat 36 in which a piston 38 is slidable axially by means of a rod 40 operated by the lever 12*a*. The piston 38 has transverse holes 42 for putting the connector 30 into communication with the connector 32 in the non-neutral or control configuration of the servocontrol 12. In the neutral configuration of the servocontrol 12**, there is no communication between the two connectors, that is, between the lines T and D.

The difference between the servocontrols 12 of the invention and the servocontrols normally used relates to a hole 44 present in the crown of the piston 38 which, in the non-neutral configuration of the servocontrol 12, puts the connector 30 into communication with the discharge connector 34. In normal servocontrols, the connector 34 is used to discharge only the small quantity of hydraulic fluid, of the order to a few $cm^3$ per minute, which leaks between the piston 38 and its seat 36. According to the invention, however, in the non-neutral position of the servocontrol 12, a predetermined flow of hydraulic fluid considerably greater than that resulting from the leakage passes through the holes 42 and the hole 44.

The sensor 18, which is of the electro-hydraulic type, comprises a hollow body 46 having respective connectors 48 and 50 for connecting it to the pump 14 and the manifold 20. The hollow body 46 has a threaded aperture **46*a* into which a stopper element 52 is screwed. The element 52 has a closed end portion 52*a* and a tubular portion 52*b* with a mouth 52*c*. The tubular portion 52*b* defines an annular interspace 53 with the body 46 and has two series of through-holes 56 and 57 respectively. The cavity formed by the body 46 and the element 52 is divided into two chambers, 54 and 58 respectively, by a piston 60 sealingly slidable within the tubular portion 52***b*. The piston 60 has a skirt 60*a*, a circumferential edge 60*b*, and a crown 60*c* of conical cusp shape. Between the piston 60 and the portion 52*a* of the element 52 is a helical spring 62 for biasing the piston 60 resiliently into contact with a proximity switch 64 carried by the body 46. The internal diameter of the tubular portion 52*b* of the element 52 is less than the internal diameter of the portion 52*a* so as to define an annular shoulder 66 in correspondence with the series of holes 56.

A duct 68 is also provided between the chamber 58 and the connector 50 and has a calibrated orifice 70 whose cross-section can be adjusted by means of a conical pin 72 the axial position of which is varied by means of a screw 74.

Figure 2:
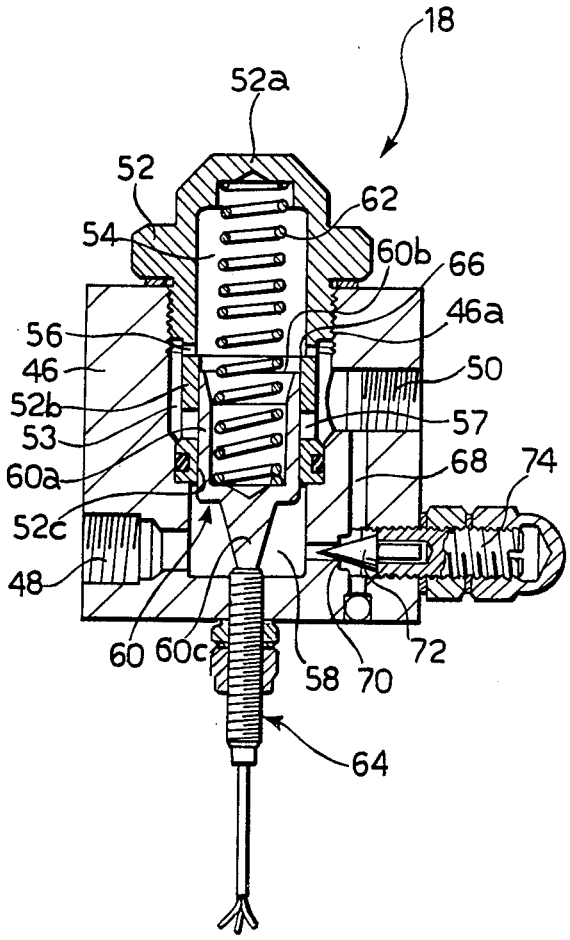
FIG. 2 is a section of a component of FIG. 1 on an enlarged scale.

In order to describe the operation of the device of the invention, it is supposed that one starts from the condition in which all the servocontrols 12 are in their neutral positions and the main engine of the earth-moving machine is idling. When the lever 12*a* of a servocontrol 12 is actuated, the piston 38 is thrust downwardly to enable communication between the lines T and D through the connector 30, the holes 42 and the connector 32. At the same time, a predetermined flow of hydraulic fluid is created through the hole 44 in the direction of the discharge connector 34. This flow causes a pressure difference between the connectors 48 and 50 in the sensor 18, this pressure difference causing the movement of the piston 60 from a first position, illustrated in FIG. 2, in which the piston prevents communication between the chambers 58 and 54, to a second position (not illustrated) in which the hydraulic fluid can pass through the holes 57 and in which communication between the chambers 58 and 54 is allowed by the holes 57, the interspace 53 surrounding the portion 52*b* of the element 52, the holes 56, and the space between the skirt 60*a* of the piston 60 and the internal diameter of the portion 52*a* of the element 52.

The movement of the piston 60 and its crown 60*c* away from the proximity switch 64 activates the power relay 29 through the electrical circuits 22 and the electromagnet 24 which puts the injection pump 28 of the main engine of the machine into operative running conditions, these conditions being settable beforehand by the operator.

When the operator returns the servocontrol 12 to the neutral position, the flow through the hole 44 in the piston 38 stops, apart from the usual and negligible leakage, whereby the corresponding pressure difference between the connectors 58 and 50 of the sensor 18 is lost. The helical spring 62 then makes the piston 60 slide from its second position to an intermediate position in which the skirt 60*a* covers the holes 57 to prevent direct communication between the chamber 58 and the chamber 54 through the holes 57, the interspace 53 and the holes 56. From this intermediate position to the first position, in which the piston 60 is in contact with the switch 64, communication between the chamber 58 and the chamber 54 is allowed only through the calibrated orifice 70, the duct 68, the interspace 53 and the holes 56. Thus, by varying the cross-section of the orifice 70, it is possible to adjust the period of delay between the positioning of the servocontrol 12 in the neutral position and the putting of the main engine of the machine into idle. This delay time enables too sensitive an operation of the sensor 18 to be avoided, together with too frequent a variation in the running speed of the engine. Moreover, the reduced flow of hydraulic fluid due to normal leakage from the servocontrols passes through the orifice 70 and the duct 68.

Whenever necessary, the operator can prevent the intervention of the sensor 18 on the circuit 22 by means of a manual switch 26 illustrated in the closed configuration in FIG. 1.

I claim:

1. Hydraulic-electric control circuit for earth-moving machines of the type having a plurality of manually operable servo controls, respective hydraulic distributor means connected to said servo controls and fuel injection pump for a main engine of an earth-moving machine, said control circuit comprising:

hydraulic pump means adapted to be driven by said main engine, hydraulic circuit means connected between said hydraulic pump means and said servo controls, each servo control having a distributor piston manually movable between a neutral non-operative position preventing hydraulic communication between said hydraulic distributor means and said hydraulic circuit means and a non-neutral operative position establishing hydraulic communication between said hydraulic distribution means and said hydraulic circuit means, said distributor piston having a through passage for maintaining limited hydraulic communication between said hydraulic circuit means and a discharge passage in said servo control when said servo control distribution piston is in said non-neutral operative position, hydraulic flow rate sensor means disposed in said hydraulic circuit means between said hydraulic pump and said servo controls, said flow rate sensor means comprising a hollow body having hydraulic input means and hydraulic output means, an obturator piston movably mounted within said body for movement between a first position in which it substantially prevents communication between said inlet and outlet means and a second position in which it allows communication between said inlet and outlet means, resilient means interposed between the body and the piston for urging the piston towards said first position, proximity switch means associated with said piston whereby siad switch means will be open when said piston is in said first position and closed when said piston is in said second position, and electromagnetic control means connected in a circuit with said switch means for operatively controlling said fuel pump means whereby when said servo contols are each disposed in the neutral position and said piston is disposed in said first position to substantially block the flow of hydraulic fluid, said switch means will be in the open condition to prevent actuation of said electromagnetic means so that said fuel injection pump means will cause said engine to operate at idle speeds and upon operation of a servo control said piston will move to said second position so that said switch means will be closed to energize said electromagnetic actuator means so that the engine will be operated at an increased speed.

* * * * *